United States Patent [19]

Lane et al.

[11] Patent Number: 4,756,695

[45] Date of Patent: Jul. 12, 1988

[54] LOCAL AREA NETWORK INTERFACE

[75] Inventors: David Lane, Greensboro; Edward K. Marsh, Kernersville; Elvert S. Watts, Walkertown, all of N.C.

[73] Assignee: AMP Incorporated, Harrisburg, Pa.

[21] Appl. No.: 88,633

[22] Filed: Aug. 21, 1987

Related U.S. Application Data

[63] Continuation of Ser. No. 874,181, Jun. 13, 1986, abandoned.

[51] Int. Cl.[4] ..... H01R 9/09; H01R 13/658

[52] U.S. Cl. ..... 439/76; 439/79; 439/535; 439/610

[58] Field of Search ..... 339/17 LC, 17 L, 17 LM, 339/17 C, 17 R, 14 R, 143 R; 361/408, 413, 415; 439/59-62, 76, 79, 535, 607-610, 95-98

[56] References Cited

U.S. PATENT DOCUMENTS

| | | | |
|---|---|---|---|
| 2,876,390 | 3/1959 | Sanders, Jr. | 339/17 M |
| 3,335,386 | 8/1967 | Upton | 339/17 L |
| 3,376,539 | 4/1968 | Robinson et al. | 339/14 R |
| 3,404,362 | 10/1968 | Amendola | 339/17 LC |
| 3,587,029 | 6/1971 | Knowles | 339/14 R |
| 3,676,746 | 7/1972 | Kassabgi et al. | 339/17 LC |
| 3,860,318 | 1/1975 | Reavis et al. | 339/99 |
| 4,079,440 | 3/1978 | Ohnuma et al. | 339/17 LM |
| 4,157,612 | 6/1979 | Rainal | 339/176 MF |
| 4,193,654 | 3/1980 | Hughes et al. | 339/17 LC |
| 4,210,376 | 7/1980 | Hughes et al. | 339/17 LC |
| 4,221,458 | 9/1980 | Hughes et al. | 339/126 R |
| 4,231,628 | 11/1980 | Hughes et al. | 339/17 LC |
| 4,292,736 | 10/1981 | Hughes et al. | 29/884 |
| 4,337,989 | 7/1982 | Asick et al. | 339/143 R |
| 4,407,559 | 10/1983 | Meyer | 339/126 R |
| 4,422,128 | 12/1983 | Zurlinden et al. | 361/408 |
| 4,501,459 | 2/1985 | Chandler et al. | 339/48 |
| 4,602,829 | 7/1986 | De Andrea | 361/415 |
| 4,612,412 | 9/1986 | Johnston | 174/65 R |

FOREIGN PATENT DOCUMENTS 1171549 11/1969 United Kingdom .

OTHER PUBLICATIONS

Technical Bulletin No. 237, Teradyne Connection Systems Inc., pp. 8, 9, 1-1985.

IBM Bulletin, Carter, vol. 21, No. 3, p. 1137, 8-1978.

*Primary Examiner*—Neil Abrams

*Attorney, Agent, or Firm*—Eric J. Groen

[57] ABSTRACT

An assembly for interconnecting more than one interfacing device has a wall mountable box having cavities therein. The cavities have an open front face and at least a partially open rear face. Edge card connectors interconnectable to shielded or unshielded cable are insertable through the rear face of the wall box. A shielded cable connector portion is insertable through the front face and has an edge card mounted thereto having conductive traces interconnected to resilient terminals, the terminals accessible through the front mating face. An unshielded cable connector portion is insertable through the front mating face of a second cavity. The unshielded connector is mounted to a printed circuit board which is interconnectable with an edge card connector within the cavity. The shielded or unshielded connectors are disposed in the front mating face for interconnection with a mating shielded or unshielded connector.

24 Claims, 15 Drawing Sheets

10
2
6
28
94
92
34
70
54
52
66
68
64
76
74
72
16
18
112
96
38
42
98
112
30
84
82
78
80
90
88
86
22
110
24
6
10

262
262
260
270
264
266
270
268

200
220
222
224
222
226
202
208
212
206
204
203
212
204
206
205
210
218
217
214
216
288
280
282
286
282
286
288
234
248
238
234
250
236
250
232
230
236
242
240
248
244
232
246

LOCAL AREA NETWORK INTERFACE

This application is a continuation of Application Ser. No. 874,181 filed Jun. 13, 1986 now abandoned.

FIELD OF THE INVENTION

The instant invention relates to a device for accommodating communication network systems where more than one type of interface is utilized in the same local area network. Modular connections allow adaptation between two different interface devices using two different telecommunication cables.

BACKGROUND OF THE INVENTION

Prior Art

Communication network systems vary in scope and design as directed by the manufactures of the interfacing devices. Some network interface devices utilize shielded systems whereas others utilize an unshielded system. Several designs of interfacing devices are known in the art.

For example, U.S. Pat. Nos. 4,501,459 and 4,193,654 relate to shielded connectors for coupling two shielded cables of a shielded information network system. These connectors are hermaphroditic in nature, that is, two identical connectors are utilized for the connection, and each connector can accommodate four lines of information.

Connectors for unshielded network interfaces are also known, for example, U.S. Pat. Nos. 4,210,376; 4,221,458; 4,292,736 and 4,231,628 relate to network connectors or modular jacks, which are mountable to printed circuit boards, and are capable of accommodating between four and eight lines of communication. These connectors include stamped and formed contacts for receiving a mating plug.

Although not previously employed in local area networks, edge connectors for interconnecting printed circuit boards to multi-conductor cable are also known in the art. For example, U.S. Pat. No. 3,860,318 shows an edge connector having stamped and formed contacts providing interconnection to circuit board traces on one end, while on the opposite end, providing a barrel-type insulation displacement device for terminating individual conductors.

There has not heretofore been a means, however, for modular interconnection of and local mounting of, the interconnection devices required to terminate two distinct local area networks, that is, a shielded system and an unshielded system.

SUMMARY OF THE INVENTION

It is an object of the invention to provide a universal system of interconnections, suitable both for a shielded and an unshielded system.

It is an object of the present invention to provide an interconnection system that is compatible with present interconnection devices.

It is an object of the instant invention to provide an interconnection system utilizing as many interchangeable components as possible, between the shielded and unshielded system.

It is an object of the instant invention to provide an interconnection system that may be utilized with an all shielded system, an all unshielded system or with a combination shielded-unshielded system.

Other objects will be apparent from the detailed description of the preferred embodiment.

The foregoing objects are achieved in the instant invention by providing a universal wall box having identical and shielded cavities therein. A printed circuit board to barrel insulation displacement device is utilized, interconnecting the conductors of the shielded or unshielded cable to the insulation displacement portions. A printed circuit board having mounted thereon a connector for either a shielded or unshielded system is interconnected to the edge card connector. The cavities may be used for mounting shielded or unshielded connectors in any combination. A mating shielded or unshielded connector can then be connected to the local interfaces, interconnecting the network interface systems with the communication network system.

BRIEF DESCRIPTION OF THE DRAWINGS

FIG. 5 shows a perspective view of a conductor to card edge interconnection device.

FIG. 13 is a front plan view of the shielded data interface assembly adaptor insert.

DETAILED DESCRIPTION OF THE PREFERRED EMBODIMENTS

Figure 1:
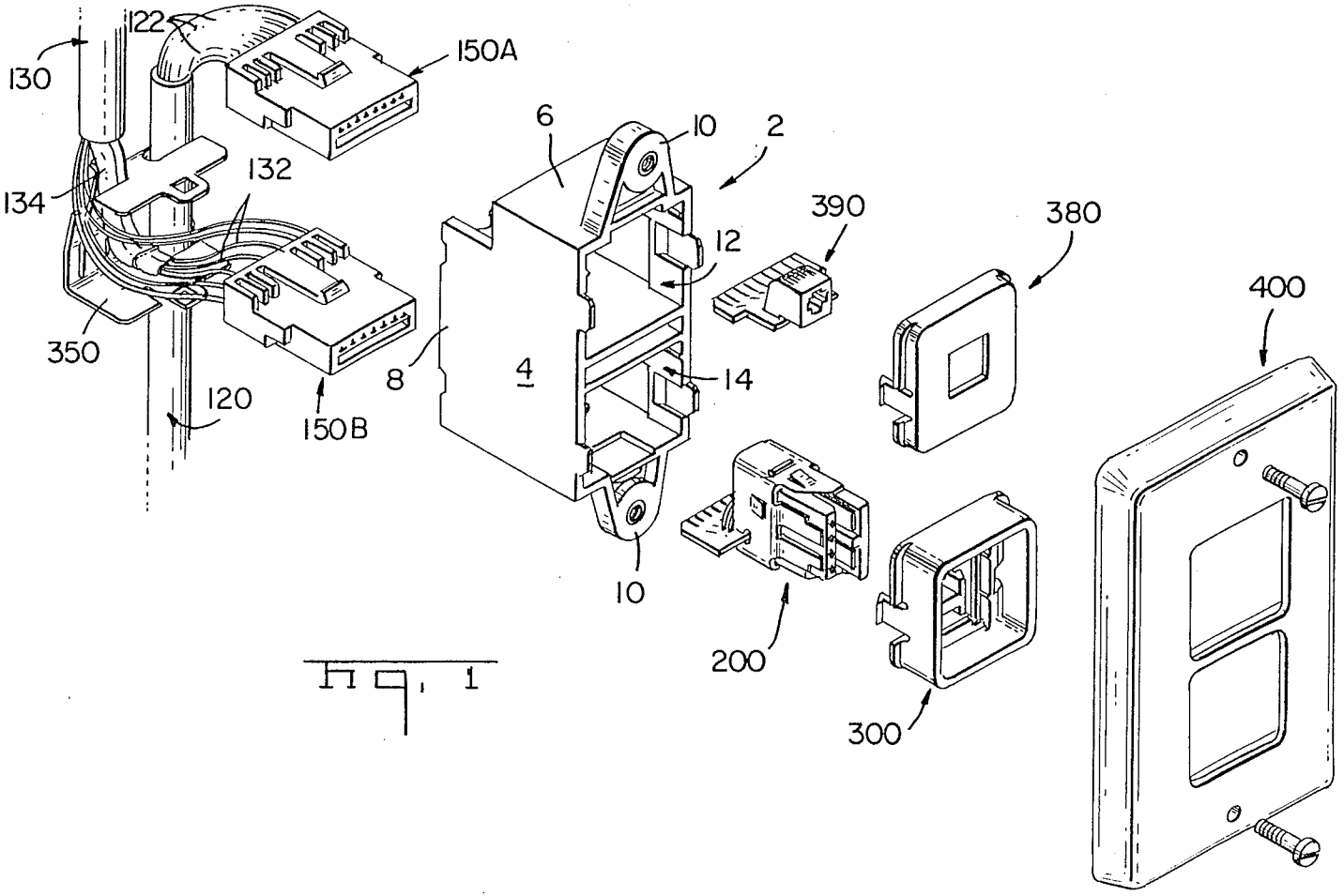
FIG. 1 is a perspective view of the total system of the instant invention.

Referring to FIG. 1 there is shown an interface interconnection system for interconnecting two different interface systems. More specifically there is shown a two-cavity wall box 2 for receiving from the rear two identical edge connectors 150A and 150B, the edge connector 150A interconnecting an unshielded cable 120 and the edge connector 150B interconnecting a shielded cable 130. The edge connectors 150A and 150B are inserted from the rear of the wall box and are locked in position within the wall box. The modular jack interface assembly 390 and the data interface assembly 200 each include an edge card and each interface assembly 390, 200 may be inserted through the front of a wall box for interconnection with the respective edge connectors 150A, 150B. Adapter inserts are positioned on the front of the wall box to secure modular jack and interface assemblies in the cavities. A face plate 400 is then placed over the completed assembly to cosmetically blend the entire system in with the wall.

Figure 2:
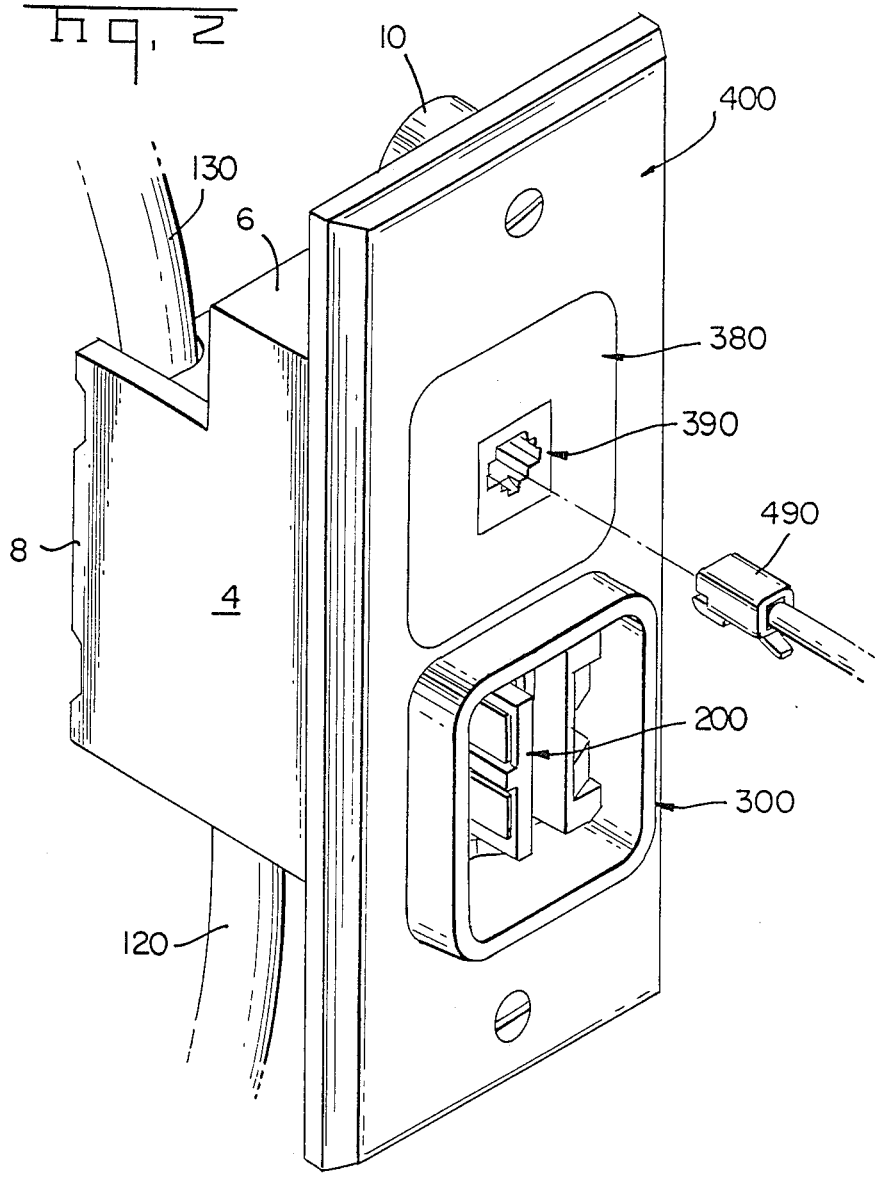
FIG. 2 shows the assembled system of FIG. 1 ready for the reception of a network interface.
Figure 3:
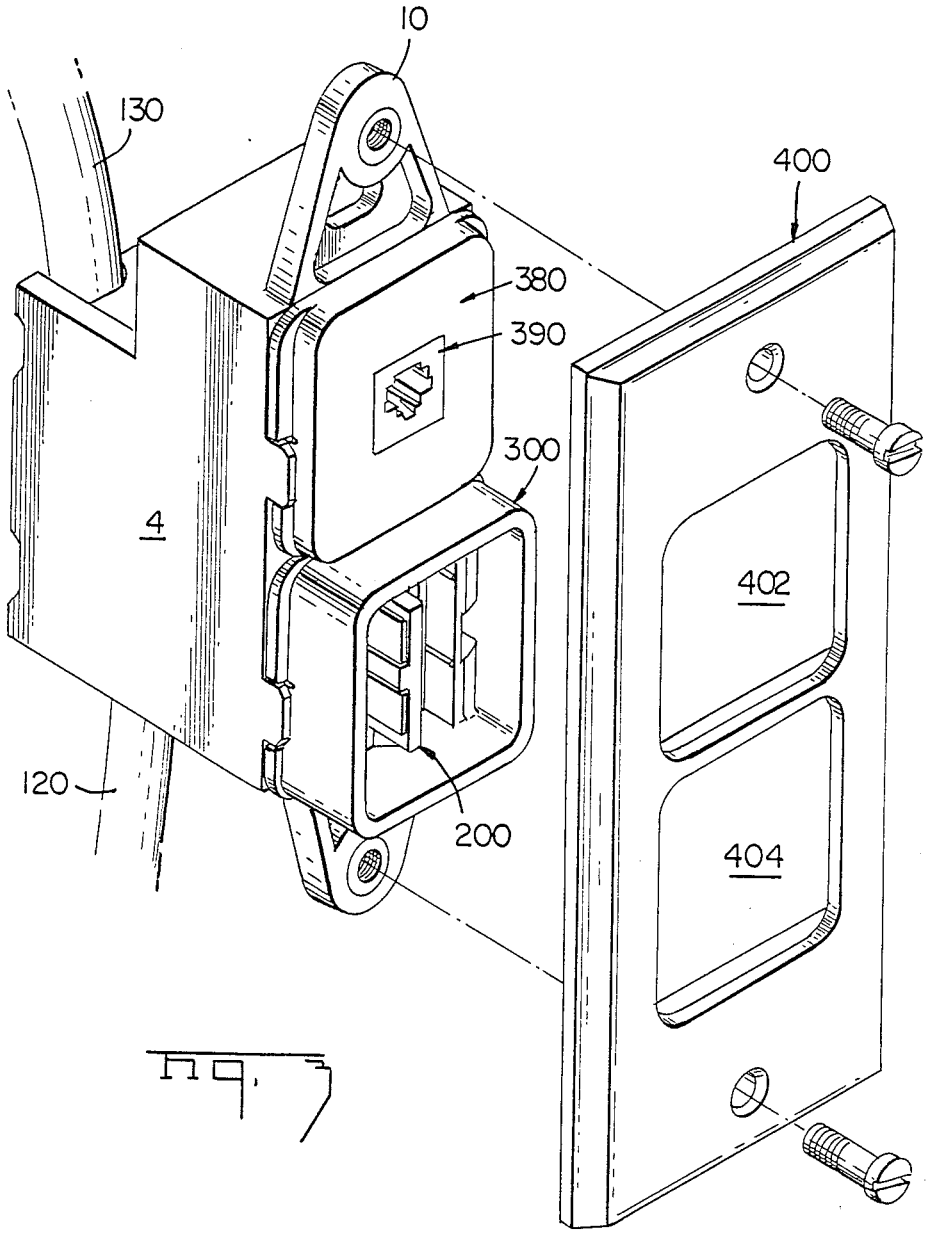
FIG. 3 is a view similar to that of FIG. 2 showing the face plate exploded away from the wall jack.

Referring now to FIG. 2, there is shown the system of FIG. 1 completely assembled. A shielded cable 130 is shown entering the wall box from the rear interconnected to data interface assembly 200. Also shown is unshielded cable 120 inserted into the wall box from the rear and interconnected with modular jack assembly 390. Modular plug 490 is shown poised for reception into modular jack assembly 390. Referring now to FIG. 3 there is shown the assembly of FIG. 2 with the face plate exploded away from the completed assembly, showing the adaptor inserts 300, 380 in an assembled configuration.

Figure 4:
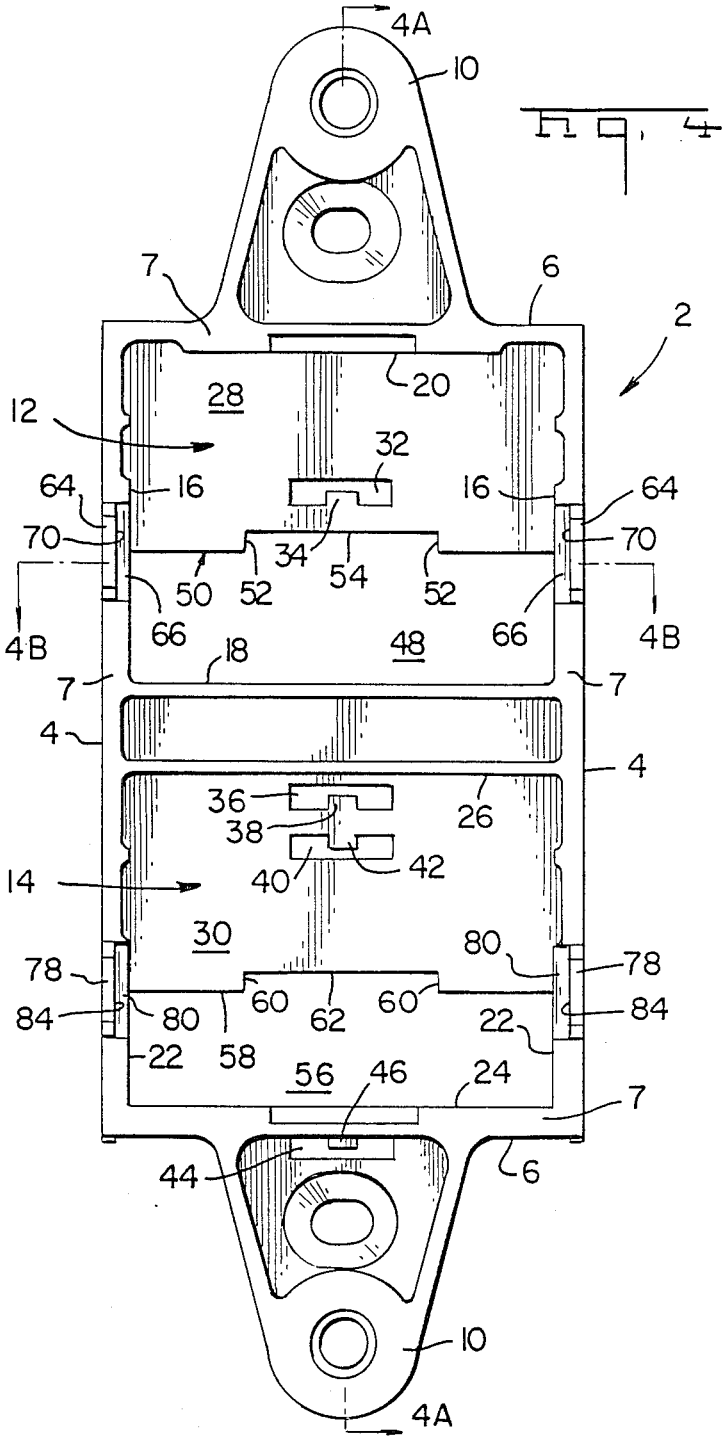
FIG. 4 is a plan view of the front of the wall box.

The wall box 2 will now be described in greater detail with reference to FIGS. 4–4C. Referring first to FIG. 4 the wall box 2 is shown as having two receiving cavities 12 and 14. The wall box 2 is generally comprised of two endwalls 6 and two sidewalls 4 with two mounting bosses 10 extending from opposite endwalls 6. The upper cavity 12 is defined by sidewalls 16, floor 18, ceiling 20 and backwall 28. It will be noticed that backwall 28 does not extend from the ceiling 20 to the floor 18, but rather, extends only from the ceiling 20 to the wall 28 ending with a lower edge 50. As such, there is an opening from the front of the wall box completely through to the rear of the wall box, providing an opening 48 for either edge connector 150A or 150B. Located on the edge 50 of wall 28 is a latch receiving area defined by side edges 52 and upper edge 54.

Similarly lower cavity 14 is defined by sidewalls 22, floor 24, ceiling 26 and rearwall 30. Once again, rearwall 30 does not extend from the ceiling 26 to the floor 24, but rather, terminates with edge 58 providing a cavity 56 for receiving either edge connector 150A or 150B from the rear. Also defined on edge 58 of wall 30 is a latch-receiving area defined by side edges 60 and upper edge 62.

Located in the center of wall 28 is aperture 32 having a locking tab 34, and located in the center of wall 30 are apertures 36, 40 having locking tabs 38, 42 respectively. Included in the lower mounting boss 10 is provided an aperture 44 having a locking tab 46.

Extending forwardly from the sidewalls 16 of upper cavity 12 and forwardly from the sidewalls 22 of the lower cavity 14 are alignment arms 64 and 78, respectively. Referring now to both FIGS. 4A and 4B, the geometrical configuration of alignment arms 64 is shown in greater detail. The alignment arms 64 have a surface 70 which is recessed from the sidewalls 16 and extend rearwardly into the cavity to a contiguous lead-in surface 66. The lead-in surface 66 then extends rearwardly back to a point coplanar with sidewalls 16. Sidewall 16 then being recessed back to a surface 72, the sudden recess defining a locking surface 68. The alignment arm 78 has a like configuration to that of arm 64 having a recessed surface 84, a lead-in surface 80 and a locking back surface 82, as shown in FIG. 4A.

Figure 4A:
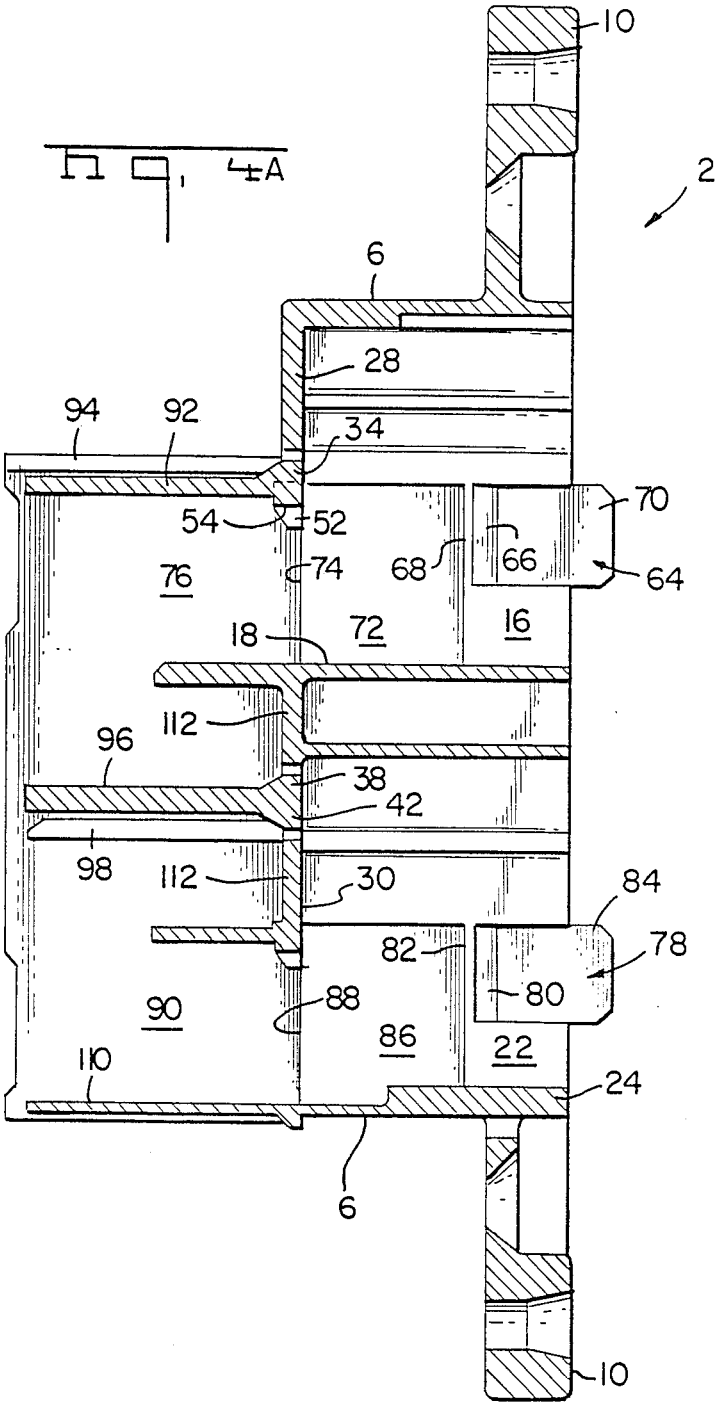
FIG. 4A is a cross section through lines 4A—4A of FIG. 4.
Figure 4B:
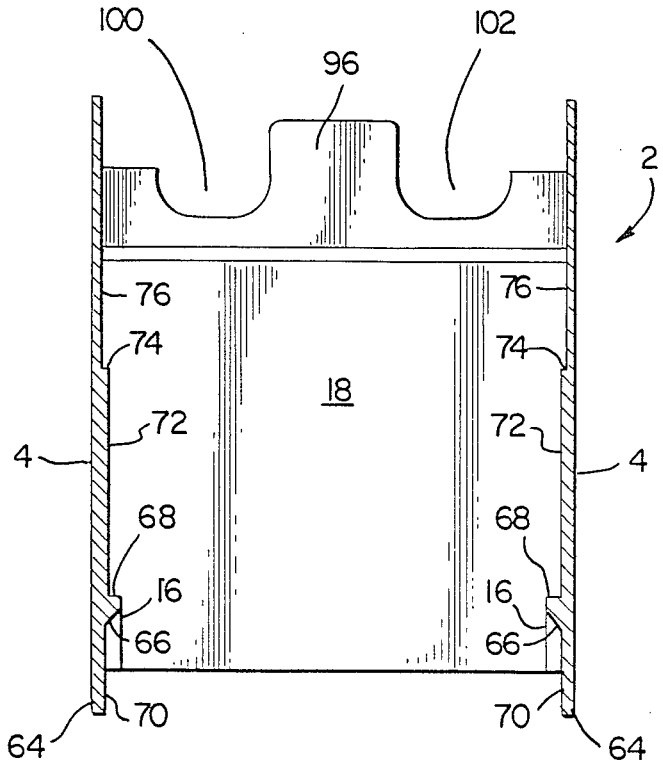
FIG. 4B is a cross section through lines 4B—4B of FIG. 4.
Figure 4C:
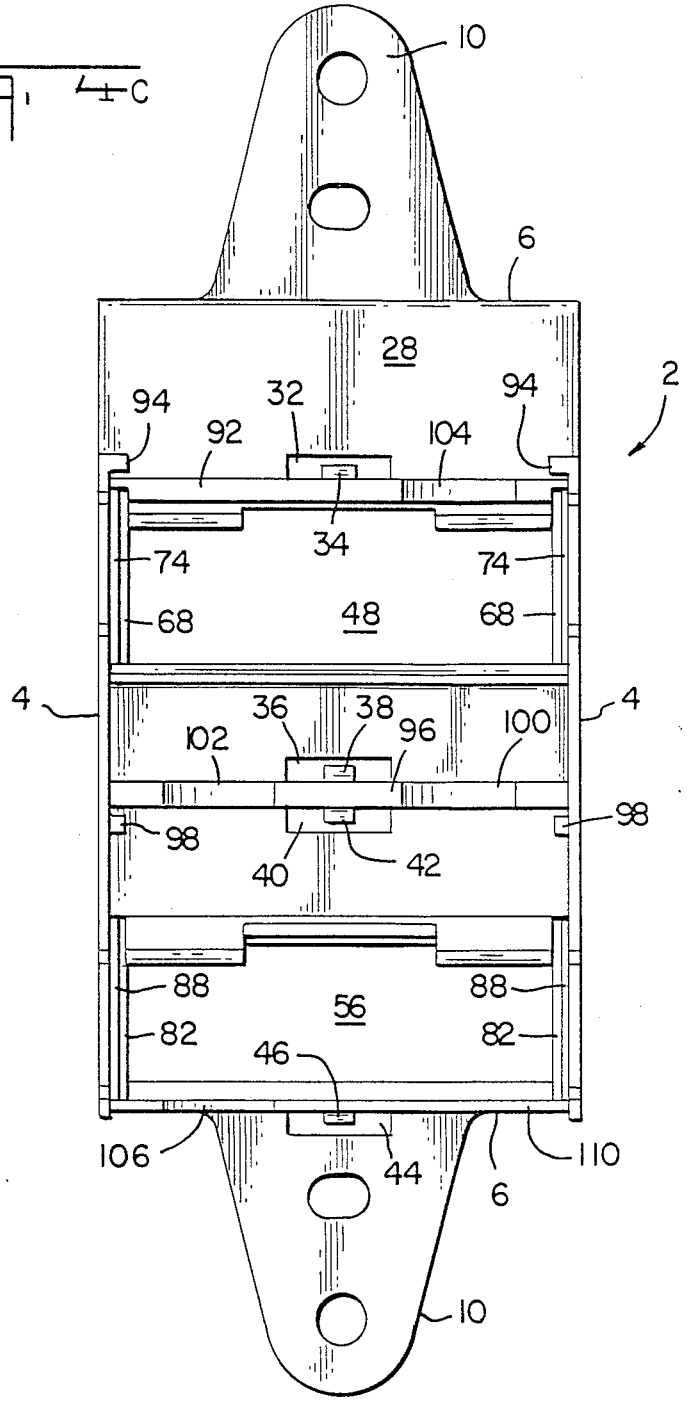
FIG. 4C is a plan view of the rear of the wall box.

As shown in FIG. 4A wall box 2 has a wall 28 and a wall 112 extending downwardly through the center of the box, and extending rearwardly from wall 28 is floor 92. Located directly above wall 92 are ribs 94. Extending rearwardly from wall 112 is a floor 96 and directly below floor 96 are ribs 98. Extending from, and contiguous with lower floor portion 24 is a floor 110 extending rearwardly into the wall box.

Referring again to FIGS. 4A and 4B, the rearward part of the upper cavity is flanked by a pair of recessed walls 76, the recessed walls 76 being offset from walls 72 forming a shoulder 74. Likewise, the lower cavity portion is flanked by a pair of recessed walls 90, the walls 90 recessed from walls 86 forming a shoulder 88. Also shown in 4B is floor 96 extending rearwardly from wall 112. At the rearward edge of floor 96 are located two cable cut-out portions 100 and 102. Referring now to Figure 4C, the rear plan view of wall box 2 shows floor 96 once again with cable cut-out portions 100 and 102. Floor 92 is also shown extending from wall 28, floor 92 having a cable cut-out portion 104 laterally aligned with cut-out portion 100 in floor 96. Floor 110 is also shown having a cable cut-out portion 106 which is laterally aligned with cable cut-out portion 102 in floor 96. FIG. 4C also shows in greater detail the card edge connector receiving areas 48 and 56.

Finally, the entire wall box 2 is a one-piece molded unit plated with a metallic coating to shield the entire box. The preferred embodiment utilizes a nickel over copper plating, although other combinations of metals could be utilized without varying from the scope or intent of the instant invention. A conductive plastic could also be employed.

Figure 7:
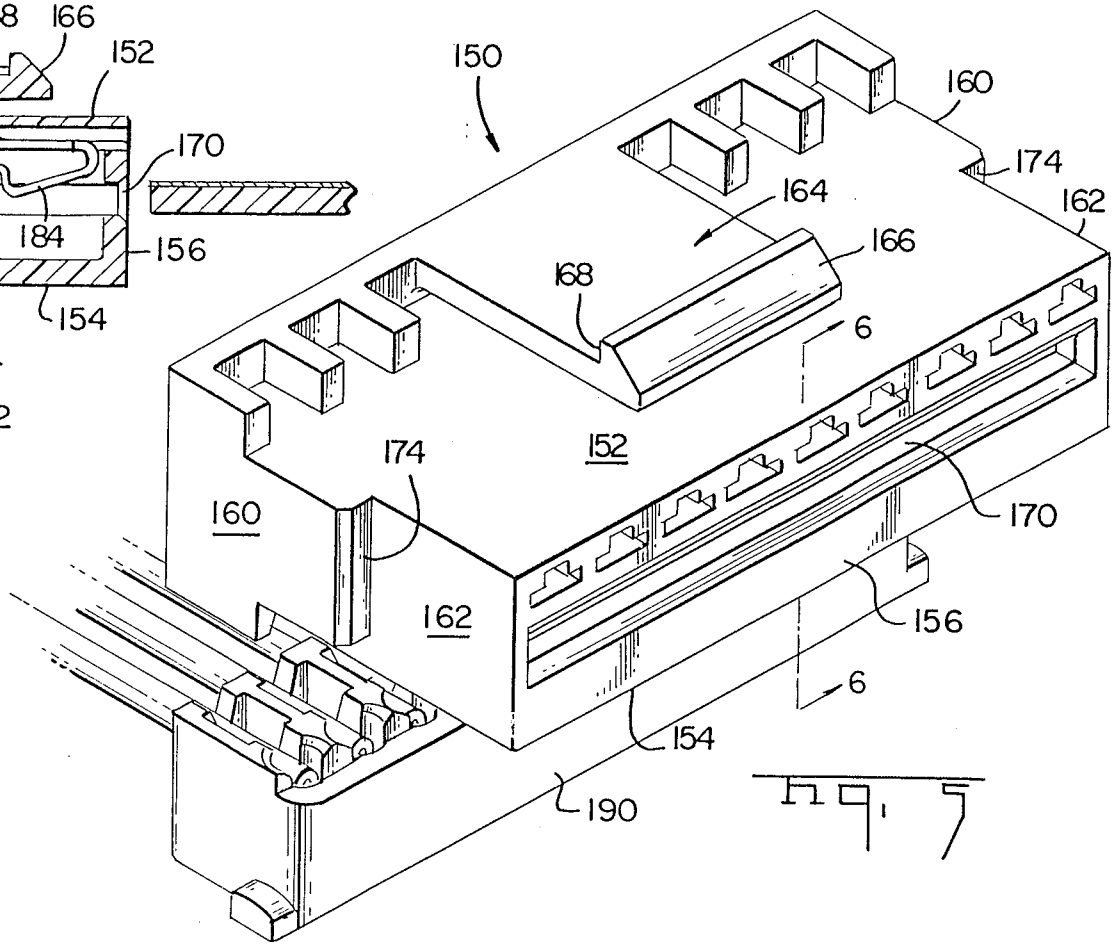
FIG. 7 shows an exploded perspective view of the hermaphroditic data connector.

Referring next to FIG. 7 the data interface assembly 200 is shown in greater detail, the assembly 200 comprising housing 202, terminals 214, stuffer cap 220, upper and lower shield members 260, 230, and printed circuit board 280. The terminal housing 202, terminals 214 and stuffer cap 220 are similar in design to those disclosed in U.S. Pat. Nos. 4,193,654 and 4,501,459, whose disclosures are incorporated herein by reference.

The insulative terminal housing 202 has a floor 205 and upstanding sidewalls 204, sidewalls 204 extending forwardly defining a mating end 203. The housing 202 also has two shield receiving slots 208 located therein. Located in the floor 205 are terminal receiving slots 210. Located on the outside of the housing 202 as an extension of the sidewalls 204 are ribs 206. Disposed along the internal surface of sidewalls 204 and generally laterally aligned with ribs 206 are channels 212.

The contact terminal 214 is shown having a resilient contact portion 218 and an insulation displacement portion 216, the portion 216 having an insulation displacement slot 217. Shown disposed above the housing 202 in FIG. 7 is stuffer cap 220 having alignment ribs 222 and conductor receiving slots 226.

Shown disposed below the housing 202 in FIG. 7 is a lower shielding member 230 comprising a floor member 240 and upstanding sidewalls 232. Extending forwardly from the sidewalls 232 are shielding wing portions 234 having stamped out of the wing portions 234, two locking lances 236. Located in the upstanding sidewalls 232 are two pairs of locking slots 248 and 250. Extending forwardly from the floor 240 are two shielding wing portions 238 and stamped from the floor portion 240 is a locking lance 242 and a printed circuit board mounting tab 246. The lower shielding portion 230 further includes a printed circuit board receiving slot 244.

Shown disposed above the stuffer cap 220 in FIG. 7 is an upper shielding portion 260, the shielding portion 260 having forwardly extending shielding wings 262. Extending outwardly from the side edges of the shielding member are two locking tabs 270. Stamped from the shielding member 260 are locking lance 264 and printed circuit board mounting tab 266. On the forward portion of the upper shield member 260 is located a printed circuit board receiving slot 268.

Also shown in FIG. 7 is a printed circuit board 280 having mounting tabs 282, wire receiving holes 288 and a recessed portion 286. Printed circuit board 280 also includes printed circuit traces 284 (FIG. 9) disposed thereon.

Figure 9:
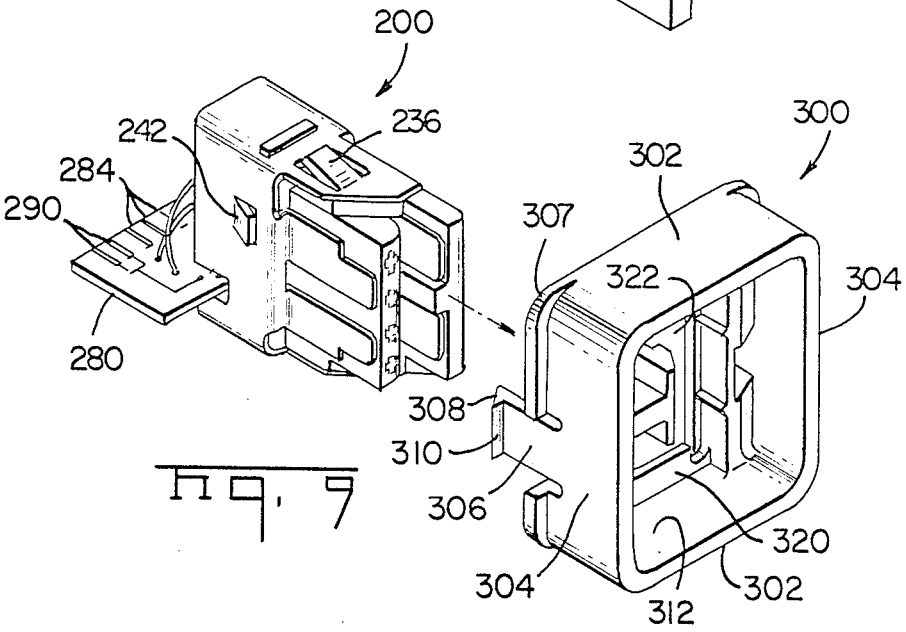
FIG. 9 shows a perspective view of the hermaphroditic electrical connector ready for insertion in a respective adaptor insert.
Figure 12:
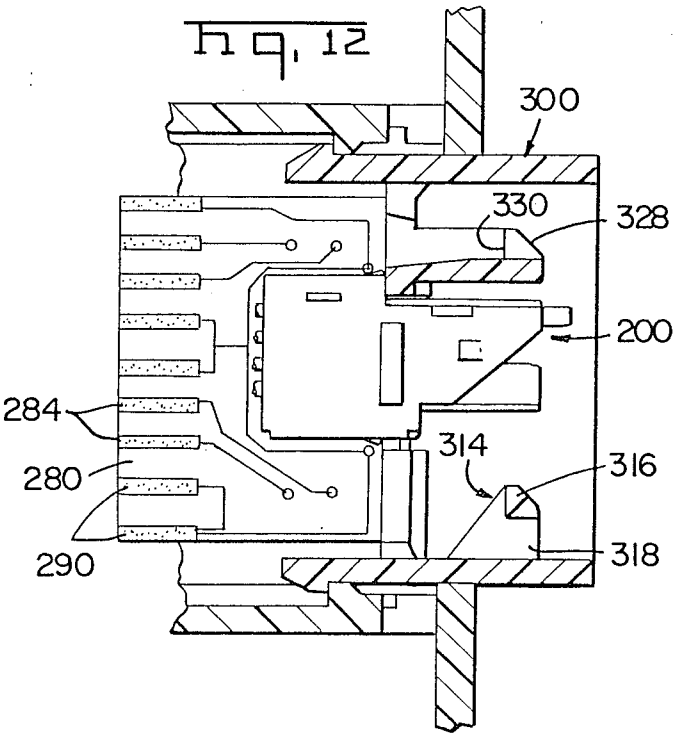
FIG. 12 shows a cross-sectional view through the shielded data interface assembly showing the locking lances on the data interface assembly in a locked configuration with the adaptor insert.
Figure 14:
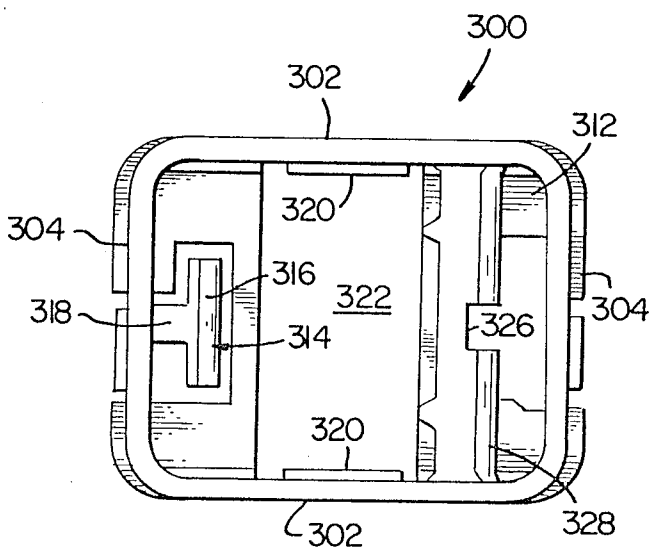
FIG. 14 is a rear plan view of the data interface assembly adaptor insert.
Figure 17:
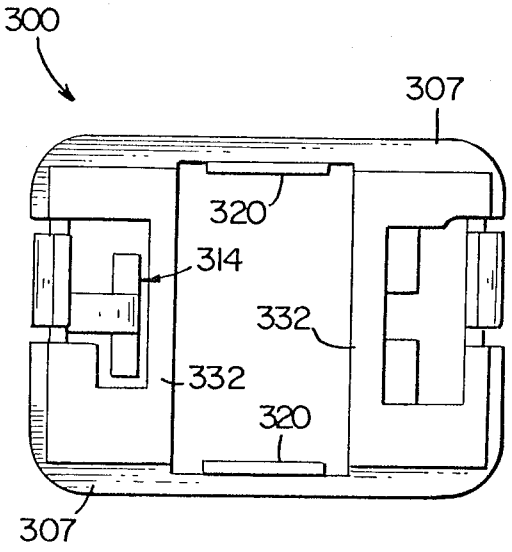
Figure 15:
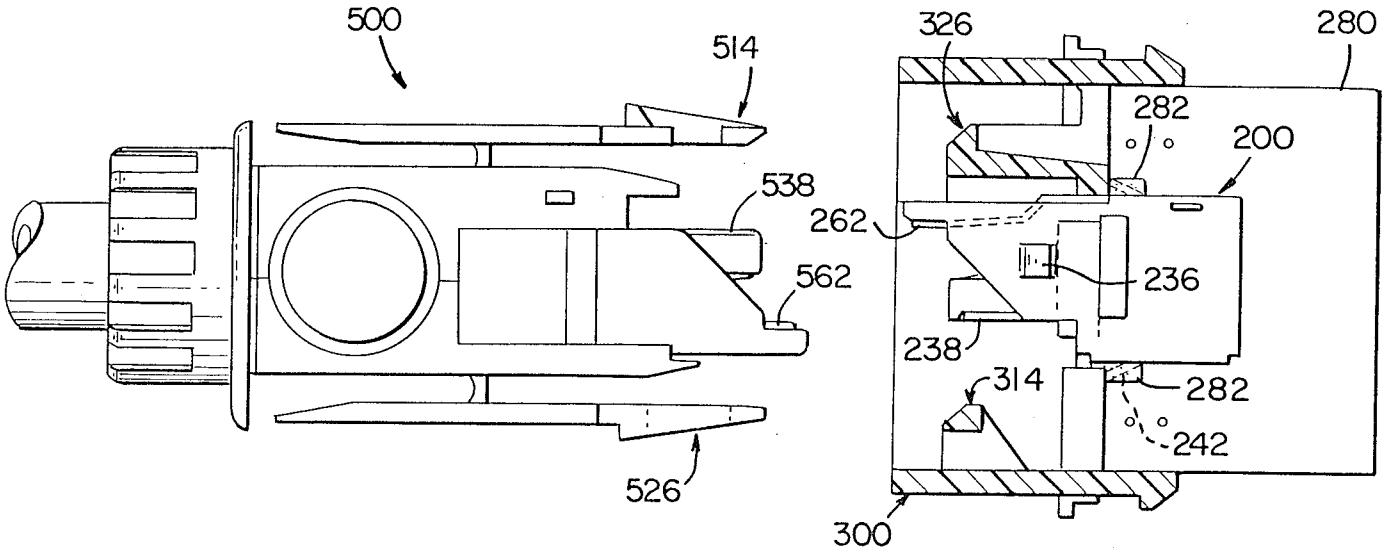
FIG. 15 shows a cross-sectional view of the data interface assembly inserted in a respective adaptor insert ready for interconnection with a mating hermaphroditic electrical connector.

Referring now to FIGS. 9, 13 and 14 there is shown in greater detail the data interface assembly adapter insert 300. The adapter 300 comprises sidewalls 304 and endwalls 302. Extending forwardly from the sidewalls 304 are two locking latches 306 comprising a lead-in section 308 and a back latching surface 310 (FIG. 9). Although adaptor 300 is molded from a plastic material, the complete interior portion of the adaptor is plated with conductive material 312 for shielding purposes. Referring more specifically to FIG. 14, on the interior of the endwalls 302 there is located two locking shoulders 320 extending from the interior of the endwalls 302. Extending from the interior of one of the sidewalls 304 is a T-bar 314 having a leg portion 318 and a lead-in surface 316. Opposed from the T-bar 314 is a T-slot 326 having a lead-in surface 328 and a backwall 330 (FIG. 12). Defined by the sidewalls and the interior surfaces of the adaptor 300 is a data interface assembly receiving area 322.

Figure 11:
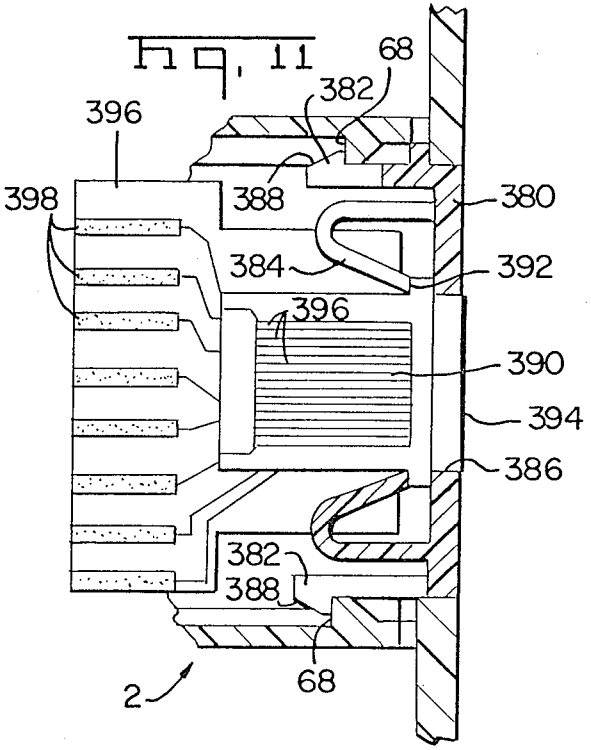
FIG. 11 shows a cross-sectional view through the modular jack adaptor insert showing the locking lances locking the modular jack to the adaptor insert.

Referring now to FIG. 11, there is shown a modular jack 390 and a modular jack adaptor 380. The modular jack 390 is similar in design to those disclosed in U.S. Pat. Nos. 4,210,376; 4,221,458; 4,231,628; and 4,292,736, whose disclosure is incorporated herein by reference. The modular jack 390 has a plug-receiving opening 394 on the forward surface of the modular jack 390. Modular jack 390 further comprises a locking shoulder 392 and stamped and formed contacts 396. The modular jack adaptor 380 comprises latch members 382, modular jack latch members 384 and modular plug opening 386.

Figure 10:
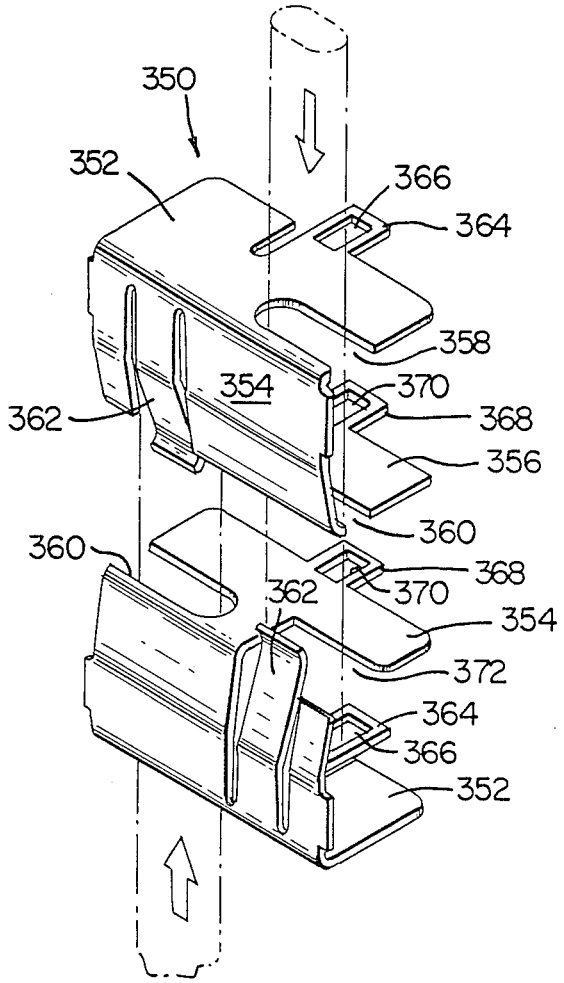
FIG. 10 is a diagrammatical sketch of the configuration of the shields when the system is used for two shielded interconnection data interface assemblies.

Referring now to FIG. 10, the removable shield members 350 are shown comprising sidewall 352, front wall 354 and opposite sidewall 356. Extending from sidewall 352 is a connection tab 364 having a connecting slot 366 therein. Also located in sidewall 352 is a wire-receiving slot 358. Extending from the forward edge of sidewall 356 is a connection tab 368 having a connection slot 370 therein. A second wire-receiving slot 360 is located in sidewall 356 in alignment with wire-receiving slot 358. Located in sidewall 356 and laterally opposed from wire-receiving slot 360 is wire opening 372. Stamped out of the front wall 354 is a shielding tongue 362.

Figure 6:
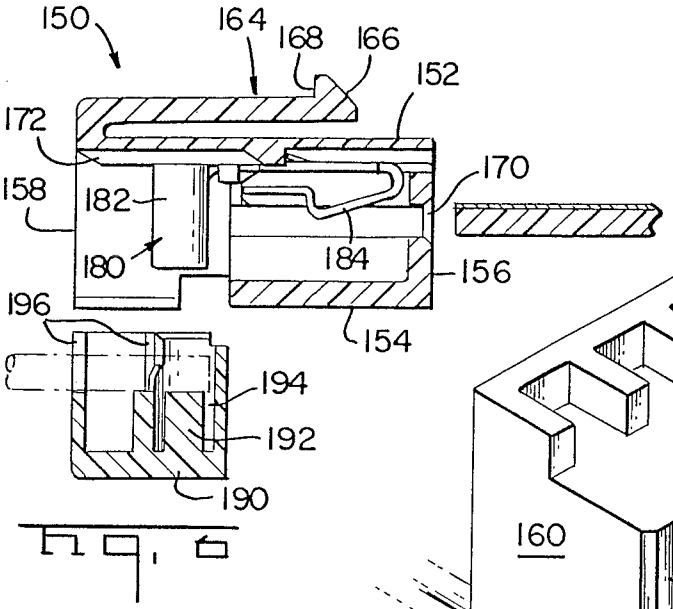
FIG. 6 shows a cross section of the conductor to card edge connector through lines 6—6 of FIG. 5.
Figure 7:
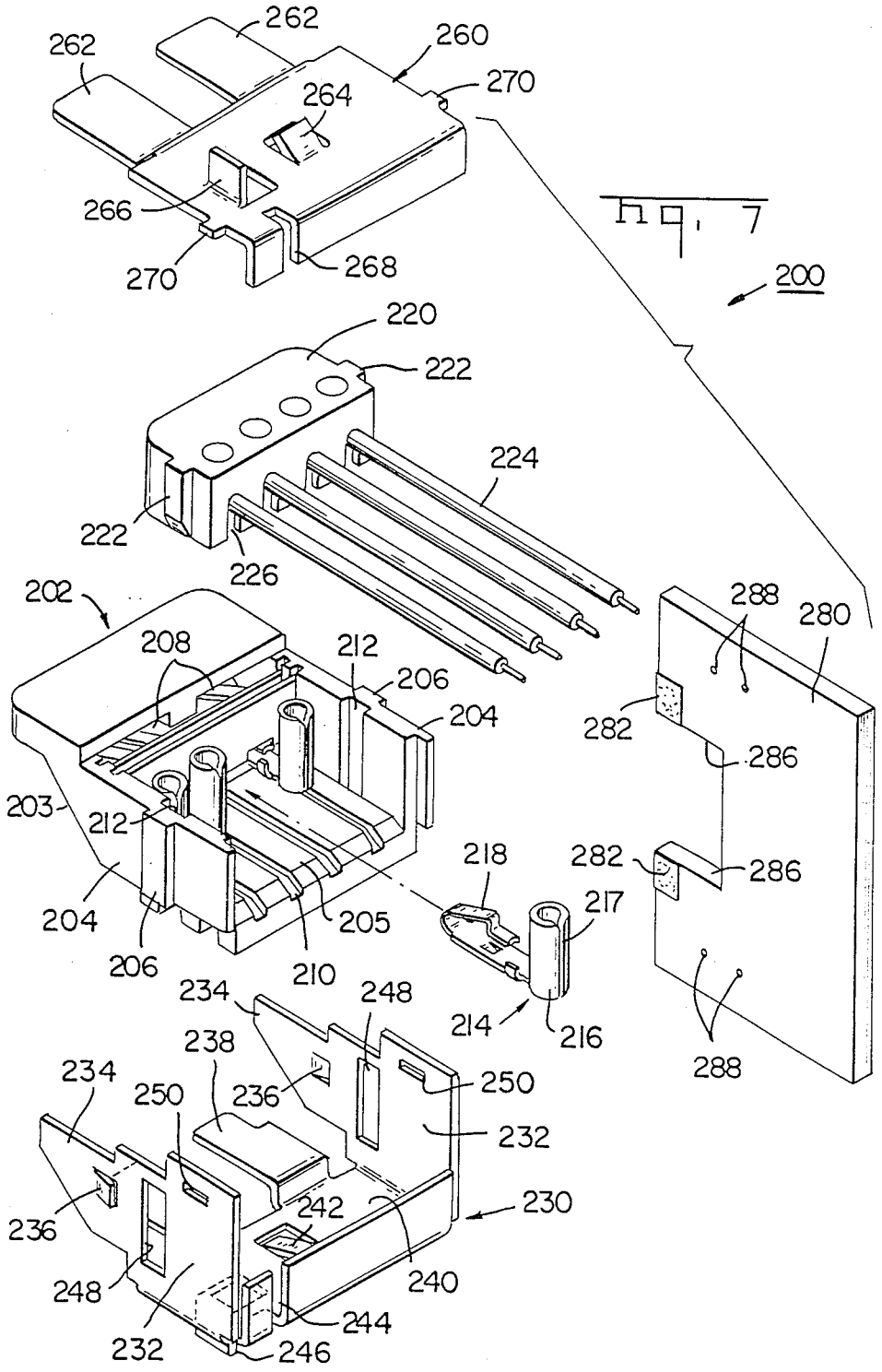
Figure 8:
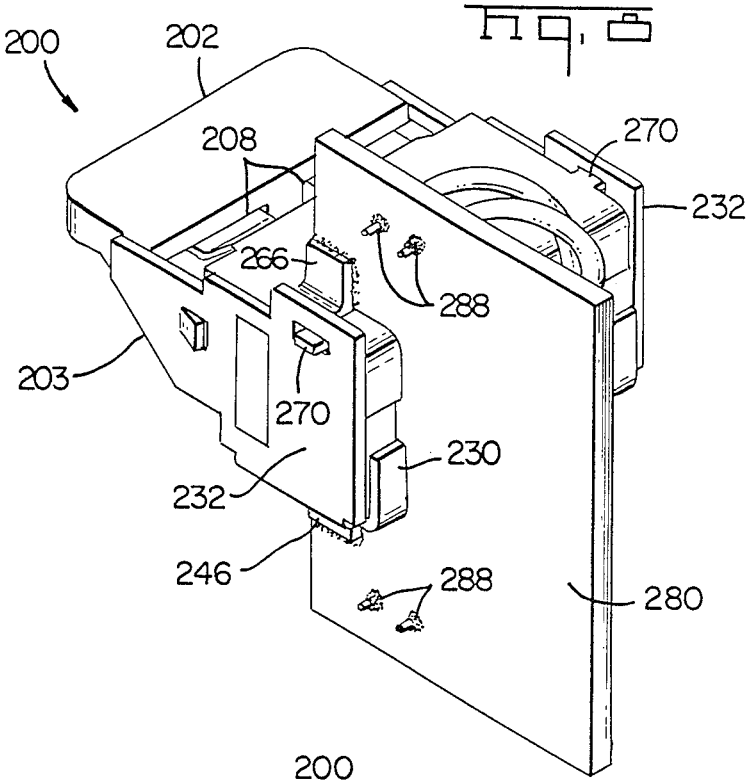
FIG. 8 shows a perspective view of the hermaphroditic electrical connector fully assembled.

Referring now to FIGS. 5 and 6, there is shown in detail the card edge connector either 150A or 150B. The connector 150 comprises top edge 152, bottom edge 154, sidewalls 160, shoulders 174, recessed sidewalls 162 and a backwall 158. Extending inward from the backwall 158 are terminal-receiving slots 172 for receiving contact terminals 180. Contact terminals 180 comprise a barrel-type insulation displacement terminal 182 and a resilient contact portion 184. Also shown in FIG. 6 is a stuffer cap 190 which has a stuffer post 192 with a surrounding circular aperture 194. The outer diameter of stuffer post 192 is smaller than the inside diameter of the barrel insulation displacment section 182. The stuffer cap 190 further includes wire-receiving slot 196. Referring again to FIG. 5, card edge connector 150A or 150B includes a latch 164 extending from the backwall 158 and disposed above the top wall 152. The latch 164 comprises a lead-in section 166 with a latching back surface 168.

The instant invention can be used as a local area network interface outlet for any combination of local area network interface devices. That is two unshielded cables 120 could be interconnected to two unshielded modular jacks 390, or two shielded cables 130 could be interconnected to two data interface assemblies 200 or one unshielded cable 120 and one shielded cable 130 could be interconnected to respective interface assemblies 390, 200, and either interface assembly 390 or 200 can be interconnected to either cavity 12, 14 as the adapter inserts 380, 300 and the edge connectors 150A, 150B are interchangeable in either of the cavities 12, 14.

In order to interconnect a shielded cable 130, it is first necessary to assemble the shielded data interface assembly 200. Referring to FIG. 7, the housing 202 must first have the terminals 214 installed therein, the side edges of the terminal 214 being received in the terminal grooves 210 in floor 205. When the terminals 214 are fully installed, the resilient contact portion 218 is disposed in the forward mating end 203. The individual conductors 224 may then be terminated to the barrel portion of the terminal 216 by placing the individual conductors in the wire-receiving slots 226 of the stuffer cap 220. With the four conductors in place in the respective wire-receiving slots 226, as shown in FIG. 7, the cap 220 is then lowered onto the housing 202, the locating ribs 222 being disposed in the stuffer cap receiving slots 212 which aligns stuffer posts (not shown) in the stuffer cap with the barrel terminals 216 which forces the individual conductors 224 into the barrel 216 terminating respective conductors into respective slots 217.

The upper and lower shielding covers 260, 230 are then installed over the housing 202 completely shielding the contact terminals 214. The lower cover 230 is first placed over the lower portion of the housing, the mounting lugs 206 fitting into the mounting slots 248 on the sidewalls 232. The upper shield 260 may then be installed over the housing 202, the shielding wings 262 being placed into the receiving slots 208 and the locking tabs 270 being placed in the mounting slots 250. The edge card 280 is then connected to the shielding members, the cutout portion 286 of the edge card 280 sliding over the upper and lower shield members 260, 230 and sliding into slots 268 and 244 of upper and lower shield 260, 230, respectively. This places the edge card mounting tabs 282 in alignment with mounting tabs 266 and 246 of the shielding members. The tabs 282 are then soldered to mounting tabs 266, 246 to mechanically mount the edge card 280 to the shielding members 230, 260 and to electrically interconnect ground traces 290 on edge card 280 to the shield members 260, 230. The individual conductors 224 may then be soldered in place to solder pads 288 in edge card 280 interconnecting the individual conductors 224 to the traces 284. As finally assembled, the contact resilient portion 218 is electrically interconnected to the conductive traces 284 on the edge card 280 via the contact terminal 214 and the individual conductors 224, and the shielding members 230, 260 are commoned to the grounding traces 290.

The completed data interface assembly 200 may then be installed in a respective data connector adaptor 300 as shown in FIG. 9. The data interface assembly 200 is installed into the assembly receiving area 322, the assembly 200 sliding into the receiving area until the mounting tabs 236 latch over the locking shoulders 320 of the adaptor 300 which also places mounting tabs 242 in abutment with the front surfaces 332 (FIG. 13) of the adaptor 300. When latching tabs 236 are in their locked position over the shoulders 320, they are also resiliently biased against the interior surface of endwalls 302. As the interior of adaptor 300 is completely plated with plating material 312, the tabs 236, biased against the endwalls 302, common the shielding members 230 and 260 to the plating material 312.

The individual conductors 132 of shielded cable 130 are then terminated to the contact terminals 180 of edge card connector 150B. The edge card connectors 150A, 150B are identical in design, the only distinguishing feature is whether the connector is used with a shielded or an unshielded cable. When referring to the design aspects of the connectors, as in FIGS. 5 and 6, reference will be made to connector 150, generally. However, when a particularly located connector is to be noted, the postscript will also be utilized.

Figure 4D:
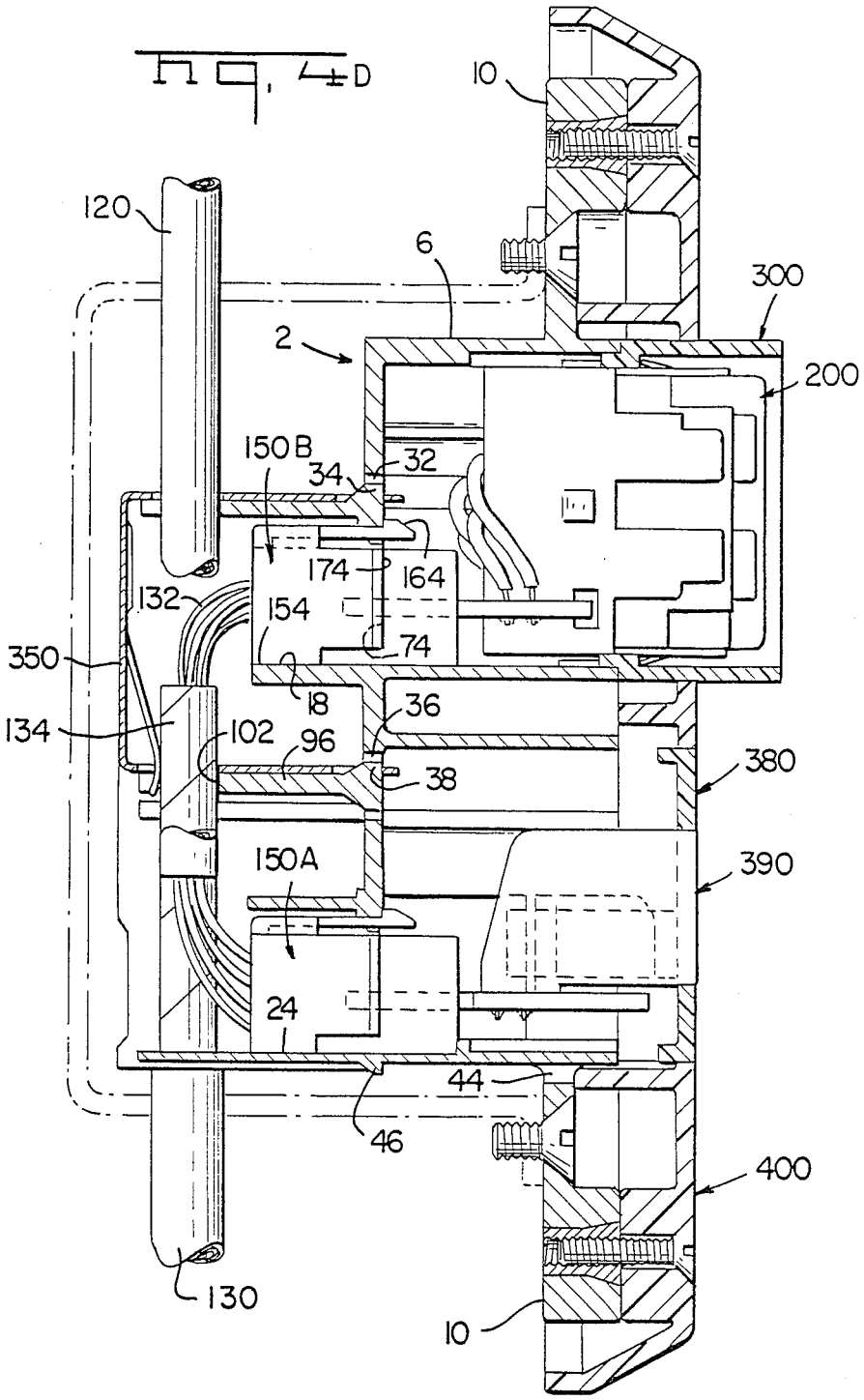
FIG. 4D shows the cross section of FIG. 4A showing the data interface devices fully assembled.

Each individual conductor 132 would be placed in the wire-receiving slots 196 of the stuffer cap 190 (FIG. 6) and would be terminated in the individual insulation displacement barrels 182, as shown in FIGS. 5 and 6. With the individual conductors 132 terminated to the contact terminals 180, the edge card connector 150B could be inserted from the rear side of wall box 2 through either of the connector-receiving areas 48 or 56 (FIG. 4C). If the edge card connector 150B is placed in the upper cavity 48, the edge card connector 150B moves forwardly until the shoulder 174, between sidewalls 160, 162, abuts shoulder 74 in the wall box 2, as shown in FIGS. 4A and 4D. When installing the edge connector 150B, the bottom surface 154 lies along the floor 18 and when shoulders 174 abut the shoulder 74 the latch member 164 latches in place such that latch member 164 fits into the latch-receiving slot defined by surfaces 52 and 54 (FIG. 4) which locks the edge card connector 150B in place.

The assembled data interface assembly 200 and adaptor 300 may then be installed into upper cavity 12 from the front side of the wall box 2. The printed circuit board 280 first enters the cavity and begins entry into edge connector 170. The latch 306 then begins engagement along surfaces 70 of alignment arms 64 which aligns the assembly 200 and adaptor 300 in the proper vertical orientation. Continued insertion of the adaptor causes the lead-in sections 308 of the adaptor 300 to ride up on the ramp 66 of the alignment arm 64 and finally lock itself, latch back surface 310 adjacent shoulder 68 of wall box 2, as shown in FIGS. 4A and 4D.

A shield member 350 would then have to be installed from the rearward side of the wall box 2 to shield the back side of data assembly 200. The cable 130 would first be disposed in the opening 372 of the shielding member 350 with the cable shielding 134 adjacent the resilient tongue 362 as shown in FIG. 10. The shielding member 350 would then be installed into the back portion of wall box 2, the sidewall 354 being placed between floor 92 and ribs 94 and sidewall 352 being placed above but adjacent to floor 96. The shielding member 350 is inserted into the wall box until tab 368 is inserted into aperture 32 and slot 36 being locked onto the locking tab 34; and locking tab 364 is disposed in slot 36 with the slot 366 overlying the tab 38.

It should be noted that the data connector assembly 200 is redundantly grounded, each level of grounding being commoned to a common potential. The assembly 200 includes a first level grounding as the shielding members 230, 260 surround the housing 202. The assembly 200 includes a second level of grounding as the wall box 2 and the adaptor 300 are plated and commoned to one another at their point of joinder, that is, between front edge 307 of adaptor 300, and front edge 7 of wall box 2. Furthermore the two levels of grounding are commoned to one potential, as tabs 236 on lower shielding member 230 are resiliently biased against the interior of sidewalls 302.

The shielded cable 130 will be oriented downwardly as shown in FIG. 4D with the cable 130 disposed in cable cutouts 102 and 106. With the shielded cable 130 disposed in this manner, the back edge of wire entry slot 102 backs up the shielded cable 130, so that, the resilient tongue 362 maintains adequate contact with the shielding braid.

If a second shielded cable is to be used, a second edge card connector will be inserted into the back side of the wall box 2 as previously described, and into the lower connector-receiving area 56. A second shielding member 350 would then be utilized, its orientation as shown in FIG. 10. It should be noted that the shield member 350 can be used in either upper 12 or lower 14 cavity, by simply inverting the shielding member. The shielding member 350 would be installed from the back side of the wall box with the sidewall 352 disposed between the ribs 98 and the floor 96 and the sidewall 356 disposed below but adjacent to floor 110. With the second shielded cable 130 inserted in the opening 372, the second shielding member 350 would be inserted until the tab 364 extends into aperture 40 and until tab 368 extends into aperture 44, slots 366, 370 overlying tabs 42, 46 respectively.

If an unshielded cable 120 and a modular jack interface assembly 390 were to be installed in cavity 14, a second shielding member 350 would not be added to the back side of wall box 2 as previously described. Rather, the individual conductors 122 of the unshielded cable 120 would be terminated to the edge card connector 150A and the connector would be installed into receiving area 56, shoulders 174 abutting shoulder 88 of wall box 2. Furthermore, bottom surface 154 would be disposed adjacent to floor 110 and latch member 164 would be locked in place in the slot defined by surfaces 60 and 62.

The modular jack interface assembly 390 would then be installed onto the adaptor 380, the latching members 384 locking onto shoulders 392 of the modular jack 390. As installed, the adaptor 386 is aligned with plug receiving opening 394 for reception of a modular plug. The modular jack 390 and adaptor 380 would then be installed into cavity 14 with the edge card 396 first mating with the edge card opening 370 of the connector 150A. The latch arms 382 are then aligned with alignment arms 78, the ramps 388 in sliding engagement with surfaces 84 of alignment arms 78 until the latch arms 382 are locked behind surfaces 82 as shown in FIG. 11.

The face plate 400 may then be placed over the wall box 2 face plate openings 402 and 404 slidably received over adaptors 380 and 300 respectively. As installed the assembly is ready for reception of a modular plug data connector 390 as shown in FIG. 2. The assembly is also ready for reception of a data interface connector of the type disclosed in U.S. Pat. Nos. 4,193,654 and 4,501,459, also incorporated herein by reference.

Hermaphroditic data connector 500 when interconnected to data interface assembly 200 interconnects like terminals in connector 500 with terminals 214, and commons like shielding wings with shielding wings 538 and shielding wings 262. When the data connector 500 is inserted the T-bar overlaps T-slot 326, and likewise the T-slot of data connector 500 overlaps T-slot 314.

Thus, the instant invention allows versatility with respect to data interfacing assemblies, and also allows for local access to any combination of shielded and unshielded systems. As each of the elements are modular in nature, the system allows for easy installation and connect/disconnect. The system also allows for interchangability between shielded and unshielded systems as either cavity of the wall box may be used for either system and as the same edge card connectors are utilized in both systems. Finally, the assembly allows for interconnection to existing data interconnection systems.

We claim:

1. A modular data connector performing as an interface to a local area network and being engagable with a complementary connector for interconnecting electronic components to the network, the modular connector being interconnectable to a multiconductor shielded data cable within the network via an edge card connector which is connected to the data cable, the modular connector comprising:

an insulating terminal support housing having a front mating face, a rear face, and a terminal support platform extending between the faces which positions a plurality of terminals onto the terminal support platform, each with resilient contact tongues adjacent the mating face, deflectable towards the terminal support platform when the mating face of the terminal support housing is interconnected with the complementary connector;

shield means surrounding the terminals and the terminal support housing; and network interconnection means including an edge card secured to said housing, orthogonally disposed relative to the terminal support platform and orthogonally disposed relative to the front mating face, for establishing a connection between each terminal and a corresponding conductor in multiconductor shielded data cable, the edge card including data traces, each trace being electrically connected to a respective terminal.

2. The modular connector of claim 1 wherein the edge card further comprises ground traces being commoned to ground pads, the data and ground traces extending substantially to an edge of the edge card and aligned for interconnection to the edge card connector.

3. The modular connector of claim 2 wherein the terminals are interconnected to the data traces on the edge card by individual wires extending between the terminals and the traces.

4. The modular connector of claim 3 wherein the shield means includes a lower shield member surrounding the exterior of the terminal support housing and an upper shield member overlying the terminals.

5. The modular connector of claim 4 wherein the terminal support housing includes sidewalls upstanding from the platform and extending between the front and rear face, and the rear face is openly accessible to the terminals, and the upper and lower shield members include lips extending from rear edges thereof to substantially enclose the rear face of the terminal housing, the lips being profiled to leave a gap therebetween for the passage of the wires.

6. The modular connector of claim 5 wherein the shield means includes means for supporting the edge card thereto.

7. The modular connector of claim 6 wherein the supporting means comprises tab means struck from the upper and lower shield members, the edge card ground pads being electrically and mechanically affixed to the tab means.

8. A local area network outlet receptacle assembly for alternatively providing interconnection of electronic equipment to alternate local area network cabling systems, the first system employing a shielded cable including individual data communication conductors, the second system employing unshielded cable having twisted pair data communication conductors, the outlet receptacle assembly comprising:

a housing having at least two compartments therein, each having an open front face and a partially open rear face, the housing including shielding means substantially surrounding at least one of the compartments;

a printed circuit board edge card connector having a front edge card opening and a rear conductor receiving opening, the edge card connector having a plurality of terminals including resilient contact portions adjacent the front edge card opening for interconnection to an edge card and a plurality of wire connecting portions for electrical interconnection to either the shielded or unshielded cable conductors, the edge card connector being insertable through, and latched at the rear face of the compartment; and a modular electrical connector mounted on a printed circuit board edge card, the electrical connector including a plurality of resilient contacts disposed at a front mating face for electrical interconnection with contacts of a complementary connector, the resilient contacts being electrically connected to circuit data traces on the edge card which extend substantially to an edge thereof, the electrical connector and printed circuit board edge card being insertable through the open front face of the housing and having latching means for securing the electrical connector within the housing, the printed circuit board edge card being insertable into the printed circuit board edge card connector to electrically connect the resilient contacts to the shielded or unshielded data communication conductors.

9. The outlet receptacle assembly of claim 8 wherein the housing is comprised of insulative material and overplated with conductive material to substantially shield the entire housing.

10. The outlet receptacle assembly of claim 9 wherein the housing has two compartments, said compartments being defined by an upper wall, a middle wall and a lower wall with sidewalls integrally connecting the walls, shield means further comprising a conductive plate being latchably attachable to the housing rear face having a resilient clip which retains a shielded braid of the shielding cable against the conductive housing.

11. The outlet receptacle assembly of claim 10 wherein the upper and middle walls have vertically aligned U-shaped slots opening outwardly from a rear edge thereof, and the lower and middle walls have vertically aligned U-shaped slots opening outwardly therefrom, the slot on the lower wall being laterally offset from the slot on the upper wall, whereby the shielded cable can be resiliently held in either set of U-shaped slots by the clip.

12. The assembly of claim 11 wherein the one conductive clip commons the cable shield to the housing, the clip having an opening through which the unshielded cable extends.

13. An assembly performing as an interface to a local area network which includes shielded data cable, the interface being connectable to electrical equipment via a hermaphroditic electrical connector which has an insulated housing including hermaphroditic latching members, the hermaphroditic connector having a first plurality of contact terminals mounted therein with resilient contact tongue portions extending towards a mating face of the hermaphroditic connector and wire terminating portions disposed towards a rearward portion of the hermaphroditic connector, the hermaphroditic connector further comprises shielding members disposed on the interior of the insulative housing and in a surrounding relationship with the contact terminals, the shielding members also having a first combination of upper and lower shielding contact portions extending to the mating face, extending above and below the contact terminals, the assembly comprising:

an insulative outlet member having at least one compartment therein, the compartment having an open front face;

a modular connector member comprising an insulative body portion having a second plurality of contact terminals contained therein, the second plurality of terminals having resilient contact tongue portions matable in an overlapping hermaphroditic relationship with the resilient contact tongue portions of the first said terminals, and conductor connecting portions, a second combination of shielding members disposed around the second plurality of terminals, said second shielding members having contact portions matable with the contact portions of the first said shielding members, and an edge card mounted to the second combination of shielding members, the edge card having circuit traces disposed thereon, said traces being electrically interconnected to said conductor connecting portions of said second plurality of terminals;

means for mounting said hermaphroditic connector to the assembly in a latched and electrically connected configuration with the modular connector, including an adapter insert which latchably attaches the modular connector to the open front face of the compartment, the adapter insert including complementary latching means for matably connecting the hermaphroditic electrical connector thereto; and an edge card connector, connectable with said edge card, having means for interconnecting said edge card traces to the individual wires of the shielded electrical cable.

14. The assembly of claim 13 wherein the compartments include partially open rear faces profiled to receive said edge card connectors.

15. The assembly of claim 14 wherein the compartment includes first shielding means in a surrounding relationship.

16. The assembly of claim 15 wherein the outlet member comprises an insulative housing which is conductively plated forming said shielding means.

17. The assembly of claim 15 further comprising second shielding means surrounding said adapter insert, the first and second shielding means being commoned together.

18. The assembly of claim 17 wherein the adapter insert is insulative material overplated with conductive material.

19. The assembly of claim 17 wherein the lower shield member includes a resilient tab biased against the second shielding means of the adapter insert.

20. The assembly of claim 13 wherein the adapter insert latching means includes a T-bar and a T-slot which is latchable to a respective T-slot and T-bar of a matable hermaphroditic connector.

21. An electrical connector assembly performing as an interface to a local area network which includes shielded data cable, the interface being connectable to electrical equipment via a matable hermaphroditic electrical connector which has an insulated housing including hermaphroditic latching members, the hermaphroditic connector having a first plurality of contact terminals mounted therein with resilient contact tongue portions extending towards a mating face of the hermaphroditic connector and wire terminating portions disposed towards a rearward portion of the hermaphroditic connector, the hermaphroditic connector further comprises shielding members disposed on the interior of the insulative housing and in a surrounding relationship with the contact terminals, the shielding members also having a first combination of upper and lower shielding contact portions extending to the mating face, extending above and below the contact terminas, the assembly being characterized in that:

the interface connector is profiled as a modular connector member comprising an insulative body portion having a second plurality of contact terminals contained therein, the second plurality of terminals having resilient contact tongue portions matable in an overlapping hermaphroditic relationship with the resilient contact tongue portions of the first said terminals, a second combination of shielding members disposed around the second plurality of terminals, said second shielding members having contact portions matable with the contact portions of the first said shielding members, and a printed circuit board mounted to the second modular connector member, the printed circuit board having circuit traces disposed thereon which are electrically interconnected to said second plurality of terminals at a first end and electrically interconnected to conductive elements at a second end, the conductive elements being profiled for matable interconnection with a complementary connector interconnected to the shielded data cable;

and in that the assembly includes means for mounting said hermaphroditic connector to the interface in a latched and electrically connected configuration with the modular connector, including adapter means which latchably attaches the modular connector thereto, and which includes latching means which are complementary with the hermaphroditic latching members for matably connecting the hermaphroditic electrical connector to the interface in a mated and registered relationship.

22. The assembly of claim 21 characterized in that the latching means includes a T-bar and a T-slot which is latchable to a respective T-slot and T-bar of a matable hermaphroditic connector.

23. The assembly of claim 21 characterized in that the printed circuit board is an edge card and the conductive elements are edge traces, the edge card being profiled for interconnection to an edge card connector.

24. In an electrical connector assembly performing as an interface to a local area network which includes shielded data cable, electrical equipment being connectable to the interface via a matable hermaphroditic electrical connector which has an insulative housing including hermaphroditic latching members having a complementary T-bar and T-slot, the hermaphroditic electrical connector having a first plurality of terminals mounted therein with resilient contact tongue portions disposed adjacent to a mating face of the hermaphroditic electrical connector and wire terminating portions disposed towards a rearward portion of the hermaphroditic electrical connector, the hermaphroditic electrical connector further comprises first shield means disposed on the interior of the insulative housing and in a surrounding relationship with the terminals, the shield means also having first upper and lower shield contact portions extending to the mating face, extending above and below the terminals, the electrical connector assembly comprising:

(a) a shielded electrical connector subassembly comprising:

(i) an insulative body portion having a terminal supporting platform with sidewalls upstanding from the platform, thereby defining an open upper face;

(ii) a second plurality of terminals contained within the insulative body portion arranged in side-by-side registration along the platform, the second plurality of terminals having resilient contact tongue portions matable in an overlapping hermaphroditic relationship with the resilient contact tongue portions of the first said terminals;

(iii) a second shield means disposed around, and secured to, the insulative body member in at least a partially surrounding relationship with an exterior of the insulative body portion and the open upper face, thereby shielding the second plurality of terminals, said second shield means having second shield contact portions matable with the first shield contact portions of the first said shield means;

(iv) means for interconnecting the second resilient contact tongue portions to individual conductors of the shielded data cable; and (v) means for commoning the second shield means with a shielding braid of the shielded data cable; and (b) insulative outlet means including a front mating face and a rear connector receiving face, the front mating face of the outlet means comprising a latching mechanism, including a T-slot and T-bar which are complementary with the respective T-bar and T-slot of the hermaphroditic electrical connector, the rear connector receiving face including latching means for receiving the shielded electrical connector subassembly from the rear of the outlet means, thereby disposing the second resilient contact tongue portions in a mating disposition adjacent to the front mating face of the outlet means, and in juxtaposition relative to the latching mechanism providing a matable complementary connection with the hermaphroditic electrical connector, whereby, when the T-bar and the T-slot of the hermaphroditic electrical connector are in latched condition with the respective T-slot and T-bar of the outlet means, the first and second resilient contact tongue portions are in an overlapping and electrically mated condition.

* * * * *